US008124020B2

(12) United States Patent
Couch et al.

(10) Patent No.: US 8,124,020 B2
(45) Date of Patent: Feb. 28, 2012

(54) APPARATUS FOR PREVENTING METAL CATALYZED COKING

(75) Inventors: Keith A. Couch, Des Plaines, IL (US); Christopher D. Gosling, Des Plaines, IL (US)

(73) Assignee: UOP LLC, Des Plaines, IL (US)

( * ) Notice: Subject to any disclaimer, the term of this patent is extended or adjusted under 35 U.S.C. 154(b) by 548 days.

(21) Appl. No.: 12/397,663

(22) Filed: Mar. 4, 2009

(65) Prior Publication Data

US 2010/0224463 A1 Sep. 9, 2010

(51) Int. Cl.
*B01J 8/18* (2006.01)

(52) U.S. Cl. ..... 422/139; 208/48 R; 208/48 AA

(58) Field of Classification Search ..... 422/139; 423/562, 563, 573.1; 208/48 R, 48 AA
See application file for complete search history.

(56) References Cited

U.S. PATENT DOCUMENTS

| | | | | |
|---|---|---|---|---|
| 4,432,864 | A | 2/1984 | Myers et al. | |
| 4,551,231 | A | 11/1985 | Kovach et al. | |
| 4,601,815 | A | 7/1986 | Forester et al. | |
| 4,954,467 | A | 9/1990 | Johnson et al. | |
| 4,986,896 | A | 1/1991 | Avidan et al. | |
| 4,988,654 | A | 1/1991 | Kennedy et al. | |
| 5,007,999 | A | 4/1991 | Chin | |
| 5,407,878 | A | 4/1995 | Kim | |
| 5,463,159 | A * | 10/1995 | Callejas et al. | 585/648 |
| 5,954,943 | A * | 9/1999 | Tong et al. | 208/48 R |
| 6,274,113 | B1 * | 8/2001 | Heyse et al. | 423/418.2 |
| 6,287,522 | B1 | 9/2001 | Lomas | |
| 6,803,029 | B2 * | 10/2004 | Dieckmann | 423/652 |
| 7,261,807 | B2 | 8/2007 | Henry et al. | |
| 7,312,370 | B2 | 12/2007 | Pittman et al. | |
| 7,763,766 | B2 * | 7/2010 | Bozzano et al. | 585/640 |
| 2008/0035527 | A1 | 2/2008 | Eng et al. | |

FOREIGN PATENT DOCUMENTS

EP 0 142 900 A2 11/1984

OTHER PUBLICATIONS

U.S. Appl. No. 12/397,647, filed Feb. 3, 2009, Couch et al.

Gall, James W., "FCC Catalyst Metals Passivation", presented at 1982 National Petroleum Refiners Assn. Annual Meeting, San Antonio, Texas.

Bohmer, R.W. "Development & Appln of FCC Catalyst Metals Passivation", Symposium on Advances in FCC Technology, Aug. 26-31, 1990. Washington, D.C.

Corma, A. Nickel Passivation on Fluidised Cracking Catalysts with Different Antimony Complexes, Applied Catalysts A: Gen. 85 (1992) 61-72, Amsterdam.

Bohmer, R.W., "Metals Passivation: Past, Present and Future", presented at 1989 National Petroleum Refiners Assn. Annual Meeting, San Francisco, CA.

Miller, R.F., "Metals Passivation: Organoantimony Compounds vs Antimony Pentoxide Dispersions", National Petroleum Refiners 1988 Annual Mtg, San Antonio, Texas.

(Continued)

*Primary Examiner* — Nina Bhat
(74) *Attorney, Agent, or Firm* — James C. Paschall

(57) ABSTRACT

A process and apparatus is described in which a sulfiding agent is added to a catalytic conversion reactor to prevent metal catalyzed coking. The catalytic reactor may be downstream from a first fluid catalytic cracking reactor that provides $C_{10}$—hydrocarbons as feed to the downstream catalytic reactor.

19 Claims, 1 Drawing Sheet

OTHER PUBLICATIONS

Heite R.S., "Gulf Cincinnati Refinery FCC Unit", Gulf Science & Technology Co; AICHE 1985 Spring Natl. Meeting, 1985 Houston, Texas.

Farag, H., "Catalytic Cracking with FCCT Loaded with Tin Metal Traps." Ind. Eng. Chem. Res. 1994, 33, 3131-3140.

Yu, W., Commercial Test of Desulfurization Agent TS-01 for FCC Naphtha, Petroleum Processing and Petrochemicals 34(5) 2003, 29-31.

Torgaard,H. "North Sea Resid Tested as FCC Feedstock", Oil & Gas Journal, Jan. 10, 1983 Technology, pp. 100-103.

Karakhanov, E.A., "Passivation of Heavy Metals as a Promising Route Towards Increasing Metals Tolerance", NEFTEKHIMIYA (ISSN 002802421) 1985 East view Publications.

Ketjen Catalysts Symposium '88, Akzo Chemicals, Erdol und Kohle—Erdgas—Petrochemie vereinigt mit Brennstoff-Chemie, Nov. 1988.

PetroFCC to Maximize Propylene Production, UOP LLC, Des Plaines, IL, Aug. 2000.

Niaei, A. Effect of Tube Materials and Special Coating on Coke Deposition, World Academy of Science, vol. 23, Aug. 2007, ISSN 1307-6884, pp. 15-17.

Ramos, J., Double Riser FCC-An Opportunity for the Petrochemical Industry, NPRA Annual Mtg, Mar. 19-21, 2006, Salt Lake City, Utah.

Nieskens, M., "MILOS—Shell's Ultimate Flexible FCC Technology inDelivring Diesel/Propylene", NPRA Annual Mtg, Mar. 9-11, 2008, San Diego, CA.

Dieckmann, G.H., "Development of Ni-Based Sulfur Resistant Catalyst for Diesel Reforming", Chevron Texaco, pp. 2-14.

Terry, R., "Coking Problems Associated with Hydrocarbon Conversion Processes", Catalytic Materials Center, Materials Research Lab. Penn State Univ., PA.

Stone & Webster PetroRiser Press Release—"Axens' PetroRiser Converts Residue to Propylene", Jun. 12, 2008.

* cited by examiner

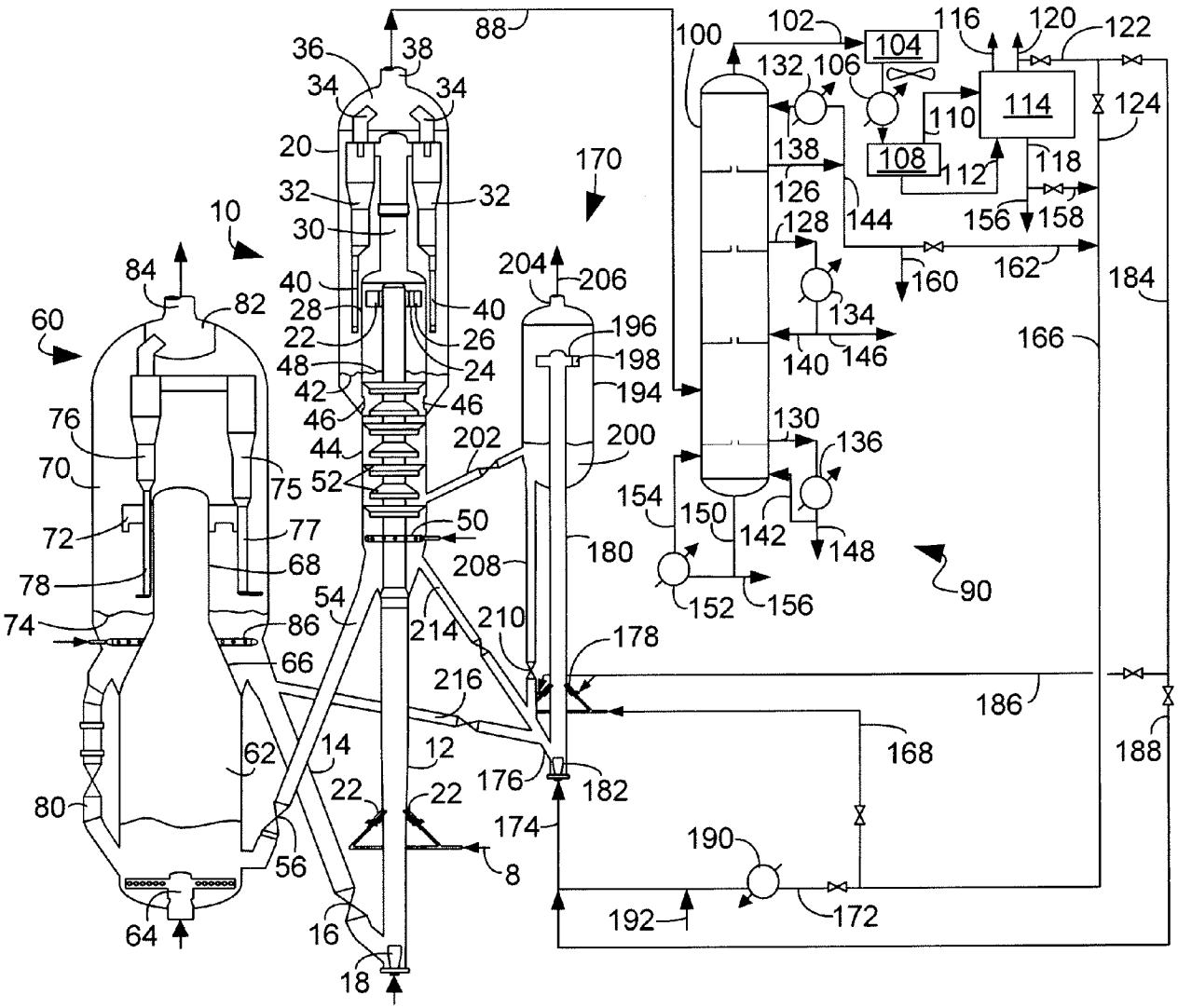
114
104
108
90
170
10
60

APPARATUS FOR PREVENTING METAL CATALYZED COKING

FIELD OF THE INVENTION

This invention generally relates to an apparatus and process for producing desired products, such as light olefins including propylene.

DESCRIPTION OF THE RELATED ART

Fluid catalytic cracking (FCC) is a catalytic hydrocarbon conversion process accomplished by contacting heavier hydrocarbons in a fluidized reaction zone with a catalytic particulate material. The reaction in catalytic cracking, as opposed to hydrocracking, is carried out in the absence of substantial added hydrogen or the consumption of hydrogen. As the cracking reaction proceeds substantial amounts of highly carbonaceous material referred to as coke are deposited on the catalyst to provide coked or spent catalyst. Vaporous lighter products are separated from spent catalyst in a reactor vessel. Spent catalyst may be subjected to stripping over an inert gas such as steam to strip entrained hydrocarbonaceous gases from the spent catalyst. A high temperature regeneration with oxygen within a regeneration zone operation burns coke from the spent catalyst which may have been stripped. Various products may be produced from such a process, including a gasoline product and/or light product such as propylene and/or ethylene.

In such processes, a single reactor or a dual reactor can be utilized. Although additional capital costs may be incurred by using a dual reactor apparatus, one of the reactors can be operated to tailor conditions for maximizing products, such as light olefins including propylene and/or ethylene.

It can often be advantageous to maximize yield of a product in one of the reactors. Additionally, there may be a desire to maximize the production of a product from one reactor that can be recycled back to the other reactor to produce a desired product, such as propylene.

Much of the focus of FCC technology development over the past few years has been in maximizing propylene selectivity. This has driven most FCC technology licensors to develop a dual-riser FCC technology offering in which the primary feedstock, typically, VGO, is fed to one riser and a recycle stream of $C_{10}$—, or any fraction thereof is recycled to a secondary riser. In this fashion, the primary riser and secondary riser can be operated in different modes to promote the most overall selective net yields. In typical operation, the primary riser would be operated less severely than the secondary riser. The secondary riser would be operated much more severely, to promote the formation of light olefins such as butylene, propylene and ethylene favored by higher temperature in the typical range of 538° to 593° C. (1000° to 1100° F.) and lower hydrocarbon partial pressure of less than 138 kPa (absolute) (20 psia). Feedstock to the secondary riser may be an FCC recycle or $C_{10}$— material from other process units.

Those who have commercialized dual riser technology in the service of recycling naphtha to the secondary riser have all suffered from excessive coke formation in the secondary riser which has resulted in limited operating capability for these processes. In the known cases, operation was limited to weeks rather than months of operation before the unit had to be shut down and the coke removed. Thus, there is a need to provide a dual reactor apparatus for catalytic cracking that can avoid excessive coke formation in the secondary riser.

SUMMARY OF THE INVENTION

We have discovered that the excessive coking in the secondary reactor is due to Metal Catalyzed Coking (MCC). MCC is inhibited in conventional FCC units because sulfur species that decompose to form hydrogen sulfide in an FCC riser are sufficiently present in the hydrocarbon feed to an FCC unit. Hydrogen sulfide subsequently passivates the active metals in the FCC unit. We propose a process and apparatus of adding a sulfiding agent to an FCC riser or other reactor when hydrogen sulfide is insufficiently present to inhibit MCC. The sulfur species in the sulfiding agent is provided as hydrogen sulfide or provides a source of hydrogen sulfide, either by decomposition, liberation, or other chemical reaction, that subsequently forms a metal sulfide layer on the interior metal surface of the reactor internals. The layer of metal sulfide isolates the vapor phase coke precursors from the active metal sites on the internal surface to inhibit coking.

BRIEF DESCRIPTION OF THE DRAWING

The FIGURE is a schematic drawing of the present invention.

DETAILED DESCRIPTION OF THE DRAWING

MCC is characterized by a deposition of carbonaceous solids on hot metal surfaces and develops in processes in excess of 400° C., with a peak filamentous carbon formation rate in the range of about 550° to about 600° C. MCC can be a function of thermal decomposition, or catalytic reaction with the active metals and can have a considerable impact on a number of commercial processes including, catalytic steam reforming of methane, steam cracking of paraffinic feed stocks and processes involving carbon monoxide disproportionation reactions. It is well known that certain metals can increase the overall MCC deposition rate by catalyzing the growth of filamentous and graphitic types of deposits. The highest catalytic activity for carbon deposition is exhibited by iron, cobalt and nickel, and alloys containing these metals. An overall catalytic reaction pathway for MCC is generally believed to be the adsorption of ethylene, propylene or butylene onto a metal surface. The adsorbed light olefin then undergoes further dehydrogenation conversion to aromatics and alkyl aromatics which further condense until coke is formed.

Typical FCC reactions operate in the range of about 500° to about 600° C., which corresponds to the peak reaction rate for filamentous carbon formation. The most active metals identified to promote MCC are present in an FCC unit. The active hydrocarbon species that promote filamentous carbon formation are ethylene, propylene and butylene which are the target products from high propylene producing FCC technologies. Consequently, we believe the coking problem in secondary FCC riser processes is attributed to MCC.

MCC has not historically been observed in FCC operations. Most FCC units process feed stocks with substantial quantities of sulfur, typically about 0.1 to about 1.0 wt-%. Sulfur present in FCC feed decomposes to hydrogen sulfide which adsorbs on the metal surface to form a metal sulfide layer which isolates gas phase coke precursors from active metal sites on internal FCC reactor surfaces, thereby mitigating coke formation. We have found that in recycle streams the hydrogen sulfide generated by cracking the primary FCC feed is not typically present in the naphtha feed recycled to secondary FCC riser. Organic sulfur in the primary FCC products distributes preferentially to hydrogen sulfide and coke in the reaction products, then distributes preferentially into the heavier products, with the least amount of sulfur remaining in the naphtha and liquefied petroleum gas (LPG). In secondary risers processing naphtha, the naphtha can be largely deficient of contaminant sulfur, resulting in insufficient sulfide layering on the metal in the secondary riser to prevent MCC. Even if sulfur is present in the naphtha, unless it is of a form that will thermally decompose to form hydrogen sulfide, it will not form a layer to passivate the active metals that contribute to MCC.

We propose to add a sulfiding agent to a catalytic reactor to prevent MCC from causing a chronic coke problem in the secondary reactor. The sulfiding agent can be hydrogen sulfide or an organic sulfur compound that decomposes to hydrogen sulfide in a catalytic conversion environment and particularly a fluid catalytic cracking environment. The hydrogen sulfide can be provided in dry gas fed to the secondary reactor prior to amine treating. Hydrogen sulfide may also be provided by adding a commercially available $SO_x$ scavenging additive, such as a magnesium aluminum oxide having a spinel structure, to the circulating catalyst inventory. The additive adsorbs $SO_x$ in the oxidizing environment of the regenerator and desorbs hydrogen sulfide in the reducing environment of the reactor riser. However, the technical capability of using a $SO_x$ additive to provide sufficient hydrogen sulfide content in the second reactor is highly dependent on the sulfur content of the feedstock to the first reactor. Preferred organic sulfur sources include commercially available sulfiding agents such as methyl sulfides like dimethyl sulfide (DMS) or dimethyl disulfide (DMDS), mercaptans and polysulfides which have been conventionally used in industrial practice as sulfiding agents for hydroprocessing units and pyrolysis furnaces. These organic sulfur sulfiding agents degrade into hydrogen sulfide in a fluid catalytic cracking and other reaction environments. Sulfur containing oils in the FCC product such as LCO, HCO and CSO are not preferred sulfiding agents because they are not expected to effectively thermally decompose to generate the quantities of hydrogen sulfide required to passivate the active metals. However, under certain conditions, these heavy FCC products may be effective. Lighter FCC products such as naphtha and LPG may also be effective sulfiding agents under certain conditions if sulfide compounds are not removed therefrom.

The addition of hydrogen sulfide bearing dry gas is preferably added to a fluidizing gas distributor or as an atomizing dispersion media to feed distributors for a riser reactor. The organic sulfur sulfiding agents may be added to a fluidizing gas distributor or preferably to the feed system any point upstream of the feed distributors. The maximum sulfur rate is not limited, but is suitably in the range of about 20 to about 2000 wppm and preferably about 50 to about 500 wppm relative to the fluids present in the reactor. The sulfiding agent should be added on a continuous basis because coking onset is very fast, and the sulfide will adsorb and desorb from the active metals on a continuous basis.

The present invention may be described with reference to four components: a primary or first reactor 10, a regenerator vessel 60, a product fractionation section 90 and a second reactor 170. Many configurations of the present invention are possible, but a specific embodiment is presented herein by way of example. All other possible embodiments for carrying out the present invention are considered within the scope of the present invention. For example if the first and second reactors 10, 170 are not FCC reactors, one or both of the regenerator vessel 60 and the product fractionation section 90 may be optional. Additionally, the invention may be embodied in a single FCC reactor 170.

The FIGURE shows the first reactor 10 which may be an FCC reactor that includes a first reactor riser 12 and a first reactor vessel 20. A regenerator catalyst pipe 14 in upstream communication with the first reactor riser 12 meaning that that material flow is permitted from the regenerator catalyst pipe 14 to the first reactor riser 12. Communication means that material flow is permitted between enumerated regions. The regenerator catalyst pipe 14 delivers regenerated catalyst from the regenerator vessel 60 at a rate regulated by a control valve 16 to the reactor riser 12 through a regenerated catalyst inlet. A fluidization medium such as steam from a distributor 18 urges a stream of regenerated catalyst upwardly through the first reactor riser 12 at a relatively high density. A plurality of feed distributors 22 in upstream communication with the first reactor riser 12 inject a first hydrocarbon feed 8, preferably with an inert atomizing gas such as steam, across the flowing stream of catalyst particles to distribute hydrocarbon feed to the first reactor riser 12. Upon contacting the hydrocarbon feed with catalyst in the first reactor riser 12 the heavier hydrocarbon feed cracks to produce lighter gaseous first cracked products while conversion coke and contaminant coke precursors are deposited on the catalyst particles to produce coked catalyst.

A conventional FCC feedstock and higher boiling hydrocarbon feedstock are a suitable first feed 8 to the first FCC reactor. The most common of such conventional feedstocks is a "vacuum gas oil" (VGO), which is typically a hydrocarbon material having a boiling range of from 343° to 552° C. (650° to 1025° F.) prepared by vacuum fractionation of atmospheric residue. Such a fraction is generally low in coke precursors and heavy metal contamination which can serve to contaminate catalyst. Heavy hydrocarbon feedstocks to which this invention may be applied include heavy bottoms from crude oil, heavy bitumen crude oil, shale oil, tar sand extract, deasphalted residue, products from coal liquefaction, atmospheric and vacuum reduced crudes. Heavy feedstocks for this invention also include mixtures of the above hydrocarbons and the foregoing list is not comprehensive. Usually, the first feed 8 has a temperature of about 140 to about 320° C. Moreover, additional amounts of feed may also be introduced downstream of the initial feed point.

The first reactor vessel 20 is in downstream communication with the first reactor riser 12 meaning that material flow is permitted from the first reactor riser 12 to the first reactor vessel 20. The resulting mixture of gaseous product hydrocarbons and spent catalyst continues upwardly through the first reactor riser 12 and are received in the first reactor vessel 20 in which the spent catalyst and gaseous product are separated. A pair of disengaging arms 24 may tangentially and horizontally discharge the mixture of gas and catalyst from a top of the first reactor riser 12 through one or more outlet ports 26 (only one is shown) into a disengaging vessel 28 that effects partial separation of gases from the catalyst. A transport conduit 30 carries the hydrocarbon vapors, including stripped hydrocarbons, stripping media and entrained catalyst to one or more cyclones 32 in the first reactor vessel 20 which separates spent catalyst from the hydrocarbon gaseous product stream. The disengaging vessel 28 is partially disposed in the first reactor vessel 20 and can be considered part of the first reactor vessel 20. Gas conduits 34 deliver separated hydrocarbon gaseous streams from the cyclones 32 to a collection plenum 36 in the first reactor vessel 20 for passage to a product line 88 via an outlet nozzle 38 and eventually into the product fractionation section 90 for product recovery. Diplegs 40 discharge catalyst from the cyclones 32 into a lower bed 42 in the first reactor vessel 20. The catalyst with adsorbed or entrained hydrocarbons may eventually pass from the lower bed 42 into an optional stripping section 44 across ports 46 defined in a wall of the disengaging vessel 28. Catalyst separated in the disengaging vessel 28 may pass directly into the optional stripping section 44 via a bed 48. A fluidizing distributor 50 delivers inert fluidizing gas, typically steam, to the stripping section 44. The stripping section 44 contains baffles 52 or other equipment to promote contacting between a stripping gas and the catalyst. The stripped spent catalyst leaves the stripping section 44 of the disengaging vessel 28 of the first reactor vessel 20 with a lower concentration of entrained or adsorbed hydrocarbons than it had when it entered or if it had not been subjected to stripping. The spent catalyst, preferably stripped, leaves the disengaging vessel 28 of the first reactor vessel 20 through a spent catalyst conduit 54 and passes into the regenerator vessel 60 at a rate regulated by a slide valve 56.

The first reactor riser 12 can operate at any suitable temperature, and typically operates at a temperature of about 150° to about 580° C., preferably about 520° to about 580° C. at the riser outlet 24. In one exemplary embodiment, a higher riser temperature may be desired, such as no less than about 565° C. at the riser outlet port 24 and a pressure of from about 69 to about 517 kPa (gauge) (10 to 75 psig) but typically less than about 275 kPa (gauge) (40 psig). The catalyst-to-oil ratio, based on the weight of catalyst and feed hydrocarbons entering the bottom of the riser, may range up to 30:1 but is typically between about 4:1 and about 10:1 and may range between 7:1 and 25:1. Hydrogen is not normally added to the riser. Steam may be passed into the first reactor riser 12 and first reactor vessel 20 equivalent to about 2-35 wt-% of feed. Typically, however, the steam rate will be between about 2 and about 7 wt-% for maximum gasoline production and about 10 to about 15 wt-% for maximum light olefin production. The average residence time of catalyst in the riser may be less than about 5 seconds.

The catalyst in the first reactor 10 can be a single catalyst or a mixture of different catalysts. Usually, the catalyst includes two components or catalysts, namely a first component or catalyst, and a second component or catalyst. Such a catalyst mixture is disclosed in, e.g., U.S. Pat. No. 7,312,370 B2. Generally, the first component may include any of the well-known catalysts that are used in the art of FCC, such as an active amorphous clay-type catalyst and/or a high activity, crystalline molecular sieve. Zeolites may be used as molecular sieves in FCC processes. Preferably, the first component includes a large pore zeolite, such as a Y-type zeolite, an active alumina material, a binder material, including either silica or alumina, and an inert filler such as kaolin.

Typically, the zeolitic molecular sieves appropriate for the first component have a large average pore size. Usually, molecular sieves with a large pore size have pores with openings of greater than about 0.7 nm in effective diameter defined by greater than about 10, and typically about 12, member rings. Pore Size Indices of large pores can be above about 31. Suitable large pore zeolite components may include synthetic zeolites such as X and Y zeolites, mordenite and faujasite. A portion of the first component, such as the zeolite, can have any suitable amount of a rare earth metal or rare earth metal oxide.

The second component may include a medium or smaller pore zeolite catalyst, such as a MFI zeolite, as exemplified by at least one of ZSM-5, ZSM-11, ZSM-12, ZSM-23, ZSM-35, ZSM-38, ZSM-48, and other similar materials. Other suitable medium or smaller pore zeolites include ferrierite, and erionite. Preferably, the second component has the medium or smaller pore zeolite dispersed on a matrix including a binder material such as silica or alumina and an inert filler material such as kaolin. The second component may also include some other active material such as Beta zeolite. These compositions may have a crystalline zeolite content of about 10 to about 50 wt-% or more, and a matrix material content of about 50 to about 90 wt-%. Components containing about 40 wt-% crystalline zeolite material are preferred, and those with greater crystalline zeolite content may be used. Generally, medium and smaller pore zeolites are characterized by having an effective pore opening diameter of less than or equal to about 0.7 nm, rings of about 10 or fewer members, and a Pore Size Index of less than about 31. Preferably, the second catalyst component is an MFI zeolite having a silicon to aluminum ratio greater than about 15, preferably greater than about 75. In one exemplary embodiment, the silicon to aluminum ratio can be about 15:1 to about 35:1.

The total mixture in the first reactor 10 may contain about 1 to about 25 wt-% of the second component, namely a medium to small pore crystalline zeolite with greater than or equal to about 1.75 wt-% of the second component being preferred. When the second component contains about 40 wt-% crystalline zeolite with the balance being a binder material, an inert filler, such as kaolin, and optionally an active alumina component, the mixture may contain about 4 to about 40 wt-% of the second catalyst with a preferred content of at least about 7 wt-%. The first component may comprise the balance of the catalyst composition. In some preferred embodiments, the relative proportions of the first and second components in the mixture may not substantially vary throughout the first reactor 10. The high concentration of the medium or smaller pore zeolite as the second component of the catalyst mixture can improve selectivity to light olefins. In one exemplary embodiment, the second component can be a ZSM-5 zeolite and the mixture can include about 4 to about 10 wt-% ZSM-5 zeolite excluding any other components, such as binder and/or filler.

The regenerator vessel 60 is in downstream communication with the first reactor vessel 20. In the regenerator vessel 60, coke is combusted from the portion of spent catalyst delivered to the regenerator vessel 60 by contact with an oxygen-containing gas such as air to provide regenerated catalyst. The regenerator vessel 60 may be a combustor type of regenerator as shown in the FIGURE, which may use hybrid turbulent bed-fast fluidized conditions in a high-efficiency regenerator vessel 60 for completely regenerating spent catalyst. However, other regenerator vessels and other flow conditions may be suitable for the present invention. The spent catalyst conduit 54 feeds spent catalyst to a first or lower chamber 62 defined by an outer wall through a spent catalyst inlet. The spent catalyst from the first reactor vessel 20 usually contains carbon in an amount of from 0.2 to 2 wt-%, which is present in the form of coke. Although coke is primarily composed of carbon, it may contain from 3 to 12 wt-% hydrogen as well as sulfur and other materials. An oxygen-containing combustion gas, typically air, enters the lower chamber 62 of the regenerator vessel 60 through a conduit and is distributed by a distributor 64. As the combustion gas enters the lower chamber 62, it contacts spent catalyst entering from spent catalyst conduit 54 and lifts the catalyst at a superficial velocity of combustion gas in the lower chamber 62 of perhaps at least 1.1 m/s (3.5 ft/s) under fast fluidized flow conditions. In an embodiment, the lower chamber 62 may have a catalyst density of from 48 to 320 kg/m$^3$ (3 to 20 lb/ft$^3$) and a superficial gas velocity of 1.1 to 2.2 m/s (3.5 to 7 ft/s). The oxygen in the combustion gas contacts the spent catalyst and combusts carbonaceous deposits from the catalyst to at least partially regenerate the catalyst and generate flue gas.

The mixture of catalyst and combustion gas in the lower chamber 62 ascend through a frustoconical transition section 66 to the transport, riser section 68 of the lower chamber 62. The riser section 68 defines a tube which is preferably cylindrical and extends preferably upwardly from the lower chamber 62. The mixture of catalyst and gas travels at a higher superficial gas velocity than in the lower chamber 62. The increased gas velocity is due to the reduced cross-sectional area of the riser section 68 relative to the cross-sectional area of the lower chamber 62 below the transition section 66. Hence, the superficial gas velocity may usually exceed about 2.2 m/s (7 ft/s). The riser section 68 may have a catalyst density of less than about 80 kg/m$^3$ (5 lb/ft$^3$).

The regenerator vessel 60 also includes an upper or second chamber 70. The mixture of catalyst particles and flue gas is discharged from an upper portion of the riser section 68 into the Lipper chamber 70. Substantially completely regenerated catalyst may exit the top of the transport, riser section 68, but arrangements in which partially regenerated catalyst exits from the lower chamber 62 are also contemplated. Discharge is effected through a disengaging device 72 that separates a majority of the regenerated catalyst from the flue gas. In an embodiment, catalyst and gas flowing up the riser section 68 impact a top elliptical cap of the riser section 68 and reverse flow. The catalyst and gas then exit through downwardly directed discharge outlets of disengaging device 72. The sudden loss of momentum and downward flow reversal cause a majority of the heavier catalyst to fall to the dense catalyst bed 74 and the lighter flue gas and a minor portion of the catalyst still entrained therein to ascend upwardly in the upper chamber 70. Cyclones 75, 76 further separate catalyst from ascending gas and deposits catalyst through diplegs 77, 78 into dense catalyst bed 74. Flue gas exits the cyclones 75, 76 through a gas conduit and collects in a plenum 82 for passage to an outlet nozzle 84 of regenerator vessel 60 and perhaps into a flue gas or power recovery system (not shown). Catalyst densities in the dense catalyst bed 74 are typically kept within a range of from about 640 to about 960 kg/m$^3$ (40 to 60 lb/ft$^3$). A fluidizing conduit delivers fluidizing gas, typically air, to the dense catalyst bed 74 through a fluidizing distributor 86. In an embodiment, to accelerate combustion of the coke in the lower chamber 62, hot regenerated catalyst from a dense catalyst bed 74 in the upper chamber 70 may be recirculated into the lower chamber 62 via recycle conduit 80.

The regenerator vessel 60 may typically require 14 kg of air per kg of coke removed to obtain complete regeneration. When more catalyst is regenerated, greater amounts of feed may be processed in the first reactor 10. The regenerator vessel 60 typically has a temperature of about 594° to about 704° C. (100° to 1300° F.) in the lower chamber 62 and about 649° to about 760° C. (1200° to 1400° F.) in the upper chamber 70. The regenerated catalyst pipe 14 is in downstream communication with the regenerator vessel 60. Regenerated catalyst from dense catalyst bed 74 is transported through regenerated catalyst pipe 14 from the regenerator vessel 60 back to the first reactor riser 12 through the control valve 16 where it again contacts feed as the FCC process continues.

In addition, the first reactor 10 can be operated at low hydrocarbon partial pressure in one desired embodiment. Generally, a low hydrocarbon partial pressure can facilitate the production of light olefins. Accordingly, the pressure in the first reactor riser 12 can be about 170 to about 250 kPa with a hydrocarbon partial pressure of about 35 to about 180 kPa, preferably about 70 to about 140 kPa. A relatively low partial pressure for hydrocarbon may be achieved by using steam as a diluent, in the amount of about 10 to about 55 wt-%, preferably to about 15 wt-% of the feed. Other diluents, such as dry gas, can be used to reach equivalent hydrocarbon partial pressures.

The first cracked products in the line 88 from the first reactor 10, relatively free of catalyst particles and including the stripping fluid, exits the first reactor vessel 20 through the outlet nozzle 38. The first cracked products stream in the line 88 may be subjected to additional treatment to remove fine catalyst particles or to further prepare the stream prior to fractionation. The line 88 transfers the first cracked products stream to the product fractionation section 90 that in an embodiment may include a main column 100 and a gas concentration section 114. A variety of products are withdrawn from the main column 100. In this case, the main column 100 recovers an overhead stream of light products comprising unstabilized gasoline and lighter gases in an overhead line 102. The overhead stream in overhead line 102 is condensed in a condenser 104 and cooled in a cooler 106 before it enters a receiver 108. A line 110 withdraws a light off-gas stream from the receiver 108. The off-gas contains LPG and dry gas. The dry gas contains hydrogen sulfide which can serve as a sulfiding agent. A bottom liquid stream of light gasoline leaves the receiver 108 via a line 112. Both lines 110 and 112 may be fed to the gas concentration section 114. In the gas concentration section 114 many streams are separated such as by fractionation to generate a light olefins line 116, a light naphtha line 118 and a dry gas line 120. The dry gas stream may be concentrated predominantly into a hydrogen sulfide stream or may be part of a more comprehensive stream, but will be represented by dry gas line 120. At least a portion of the dry gas stream is taken by recycle dry gas sulfiding agent line 122 to feed dry gas mixing sulfiding agent line 124 and/or dedicated dry gas sulfiding agent line 184. The main column 100 also provides a heavy naphtha stream, a light cycle oil (LCO) stream and a heavy cycle oil (HCO) stream through lines 126, 128 and 130, respectively. Parts of the streams in the lines 126, 128 and 130 are all circulated through heat exchangers 132, 134 and 136 and reflux loops 138, 140 and 142, respectively, to remove heat from the main column 100. Streams of heavy naphtha, LCO and HCO are transported from the main column 100 through respective lines 144, 146 and 148. A clarified oil (CO) fraction may be recovered from the bottom of the main column 100 via a line 150. Part of the CO fraction is recycled through a reboiler 152 and returned to the main column 100 through a line 154. The CO stream is removed from the main column 100 via a line 156.

The light naphtha fraction preferably has an initial boiling point (IBP) below about 127° C. (260° F.) in the $C_5$ range; i.e., about 35° C. (95° F.), and an end point (EP) at a temperature greater than or equal to about 127° C. (260° F.). The boiling points for these fractions are determined using the procedure known as ASTM D86-82. A portion of the light naphtha stream in light naphtha line 118 may be recovered in line 156 for further processing or storage and another portion in feed line 158 regulated by a control valve may be delivered to recycle feed line 166 for recycle as feed to the second reactor 170. The heavy naphtha fraction has an IBP at or above about 127° C. (260° F.) and an EP at a temperature above about 200° C. (392° F.), preferably between about 204° and about 221° C. (400° and 430° F.), particularly at about 216° C. (420° F.). A portion of the heavy naphtha stream in line 144 may be recovered in line 160 for further processing or storage and another portion in line 162 regulated by a control valve may be delivered to recycle feed line 166 for recycle as feed to the second reactor 170. The LCO stream has an IBP at about the EP temperature of the heavy naphtha and an EP in a range of about 260° to about 371° C. (500° to 700° F.) and preferably about 288° C. (550° F.). The HCO stream has an IBP of the EP temperature of the LCO stream and an EP in a range of about 371° to about 427° C. (700° to 800° F.), and preferably about 399° C. (750° F.). The CO stream has an IBP of the EP temperature of the HCO stream and includes everything boiling at a higher temperature.

It is also contemplated that in the product recovery section 90 that a less refined separation of dry gas from LPG and/or naphtha streams may be performed to allow hydrogen sulfide containing dry gas to be added to the second reactor 170 in a hydrocarbon feed line containing the LPG and/or naphtha stream instead of by transport through a separate sulfiding agent line.

The second reactor 170 may be a second FCC reactor. Although the second reactor 170 is depicted as a second FCC reactor, it should be understood that any suitable reactor can be utilized, such as a fixed bed or a fluidized bed. The second hydrocarbon feed may be fed to the secondary FCC reactor in recycle feed line 166 via feed distributor line 168 and/or fluidizing feed line 172 and fluidizing distributor supply line 174. The second feed can at least partially be comprised of $C_{10}$— hydrocarbons and preferably $C_4$ to $C_{10}$ olefins. Preferably, the second hydrocarbon feed predominantly comprises hydrocarbons with 10 or fewer carbon atoms. Predominantly means over 50 wt-% and preferably over 80 wt-%. The second feed may comprise any hydrocarbon containing feed that is low in sulfur compounds that decompose to hydrogen sulfide such as a pyrolysis oil from a pyrolysis reactor, Fischer-Tropsch wax from a Fischer-Tropsch reactor, reformate from a catalytic reforming reactor, straight run naphtha from a crude column and animal fat and vegetable oils from an appropriate reactor or source. The second feed is preferably a portion of the first cracked products produced in the first reactor 10, fractionated in the main column 100 of the product fractionation section 90 via recycle feed line 166 and provided to the second reactor 170. In an embodiment, the second reactor is in downstream communication with the product fractionation section 90 and/or the first reactor 10 which is in upstream communication with the product fractionation section 90. The second reactor 170 can include a second reactor riser 180. The second hydrocarbon feed is contacted with catalyst delivered to the second reactor 170 by a catalyst return pipe 176 in upstream communication with the second reactor riser 180 to produce cracked upgraded products.

The present invention contemplates adding a sulfiding agent to the second reactor 170 to inhibit metal catalyzed coking therein. The recycle dry gas sulfiding agent line 122 is a dedicated source of a sulfiding agent in upstream communication with the second reactor riser 180. In other words, dry gas and hydrogen sulfide would not be fed to the second reactor 170 except to prevent metal catalyzed coking because they will not convert to desirable hydrocarbon products and will have to be removed from the upgraded products exiting the second reactor 170. The introduction of hydrocarbon feed and sulfiding agent to the second reactor 170 can be performed in several embodiments shown in the FIGURE.

In a first embodiment, the second hydrocarbon feed can be injected into a second reactor riser 180 by a feed distributor 178 in upstream communication with the second reactor riser 180 and in downstream communication with a feed distributor line 168 which is in downstream communication with recycle feed line 166. Feed distributor line 168 may take a portion or all of the recycle feed stream from recycle feed line 166. The recycle feed line 166 is in downstream communication with the overhead line 102 of the main column 100 which is in downstream communication with the first reactor 10. The feed rate in feed distributor line 168 may be regulated by a control valve. The feed distributor 178 may be located above a fluidizing distributor 182 which is in upstream communication with the second reactor riser 180. The fluidizing distributor 182 provides a fluidizing gas, such as steam and/or a light hydrocarbon, to the second reactor riser 180 to fluidize the catalyst. In such an embodiment, dry gas from recycle dry gas sulfiding agent line 122 may be independently added to the fluidizing distributor 182 in a base of the second reactor riser 180 via dedicated dry gas sulfiding agent line 184 in downstream communication with the recycle dry gas sulfiding agent line 122 and bypassing atomizing dry gas sulfiding agent line 186 in fluidizing sulfiding agent line 188 and fluidizing distributor supply line 174. The dry gas thus serves both as a fluidizing gas and as a sulfiding agent added to the second reactor riser 180 of the second reactor 170. The recycle dry gas sulfiding agent line 122, the dedicated dry gas sulfiding agent line 184 and the fluidizing sulfiding agent line 188 are dedicated sources of a sulfiding agent in upstream communication with the fluidizing distributor 182 and the second reactor 170. Dry gas bearing hydrogen sulfide in recycle dry gas sulfiding agent line 122, dedicated dry gas sulfiding agent line 184 and fluidizing sulfiding agent line 188 can also be used as an inert fluidizing gas for other parts of the second reactor 170. In this embodiment, control valves in feed lines 158 and/or 162 and 168 and in sulfiding agent lines 122, 184 and 188 may be open and control valves in feed lines 172 and sulfiding agent lines 124 and 186 may be closed.

In a second embodiment, when the second feed is liquid, a dry gas containing hydrogen sulfide may be added to the liquid second feed in the feed distributor 178 to atomize the liquid hydrocarbon second feed and passivate metals in the second reactor. The recycle dry gas sulfiding agent line 122 is a dedicated source of a sulfiding agent in upstream communication with the feed distributor 178 via atomizing dry gas sulfiding agent line 186. Atomizing dry gas sulfiding agent line 186 in downstream communication with dedicated dry gas sulfiding agent line 184 provides dry gas to a gas inlet of the feed distributor 178. Sulfiding agent may be added to the second reactor according to this embodiment in addition to or instead of the way sulfiding agent is added in the first embodiment; i.e., by addition through the fluidizing distributor 182. Consequently, opening of control valve in line 186 in addition to the control valves opened and closed in other embodiments will allow operation according to this second embodiment. Accordingly, at least the control valves in sulfiding agent lines 122, 184 and 186 must be opened to operate under this embodiment.

In a third embodiment, essentially all of the second hydrocarbon feed in recycle feed line 166, i.e., at least about 90%, by mole is in a gas phase. Generally, the temperature of the second hydrocarbon feed can be about 120° to about 600° C. when entering the second reactor riser 180 and, preferably, at least be above the boiling point of the components. In this embodiment, the second hydrocarbon feed can be fed directly to the fluidizing distributor 182 in the base of the second riser to fluidize the catalyst and to feed the second reactor riser 180. In this embodiment, shown in the FIGURE, one or all of control valves in sulfiding agent lines 122 and 124 and feed lines 158 and/or 162 and 172 are open to allow dry gas containing hydrogen sulfide in recycle dry gas sulfiding agent line 122 and dry gas mixing sulfiding agent line 124 and light naphtha in light naphtha line 158 and/or heavy naphtha in heavy naphtha line 162 to recycle as secondary feed in recycle feed line 166, fluidizing feed line 172 and fluidizing distributor supply line 174 to be distributed to the riser by fluidizing distributor 182. Valves in feed line 168 and sulfiding agent lines 184, 186 and 188 may typically be closed in this embodiment. The dry gas should contain sufficient hydrogen sulfide to passivate the metals that can catalyze coking in the second reactor riser 180 of the second reactor 170. A heat exchanger 190 may be necessary on fluidizing feed line 172 to vaporize the recycled secondary feed. In this embodiment, fluidizing distributor supply line 174 serves as a feed line and the fluidizing distributor 182 serves as a feed distributor.

Hydrogen sulfide, in dry gas or not, or organic sulfur additives such as methyl sulfides, mercaptans and polysulfides may be suitable additive sulfiding agents that are added to the second reactor 170. The additive sulfiding agents may be added to the second feed in feed lines 158, 162, 166, 168, 172 or 174 or elsewhere upstream of the second reactor 170. For example, additive sulfiding agent line 192 may add a sulfiding agent directly to the fluidizing feed line 172. Sulfiding agents may also be added directly to the second reactor riser 180, to fluidizing gas upstream of the fluidizing distributor 182 or even to the catalyst entering the riser in catalyst return pipe 176. If a $SO_x$ scavenger additive is added to the catalyst, hydrogen sulfide adsorbed on the additive may be delivered to the second reactor 170 via pipe 216 and catalyst return pipe 176, making one or both of the catalyst return pipe 176 and pipe 216 a sulfiding agent line. The sulfiding agent stream in the sulfiding agent line preferably has a concentration of at least 1000 wppm of hydrogen sulfide or a compound that can convert to hydrogen sulfide in the reactor environment. The concentration of sulfur relative to the fluids in the second reactor 170 should be maintained to be at least about 20 wppm and preferably about 50 wppm. In a riser reactor, the concentration of sulfur should be maintained to be at least about 20 wppm and preferably about 50 wppm relative to the hydrocarbon and inert gases in the reactor. In an embodiment, the concentration of sulfur relative to the fluids in the second reactor should be maintained to be no more than about 2000 wppm and preferably no more than about 500 wppm. In a riser reactor, the concentration of sulfur should be maintained to be no more than about 2000 wppm and preferably no more than about 500 wppm relative to the hydrocarbon and inert gases in the reactor.

The sulfiding agent lines 122, 124, 176, 184, 186, 188 and 192 are distinct from the feed lines 158 and 162. When the control valve in line 124 is closed, lines 166, 168 and 172 are also feed lines from which sulfiding agent lines 122, 184, 186 and 188 are distinct. When control valves in lines 124 and 172 are closed, fluidizing feed line 172 no longer carries feed but fluidizing distributor supply line 174 becomes a sulfiding agent line from which feed lines 158, 162, 166 and 168 are distinct. Although the streams in the sulfiding agent lines and feed lines may be mixed in a downstream location, these streams are separate from each other in at least an upstream location. Accordingly, sulfiding agent lines provide a sulfiding agent that is separate from the second hydrocarbon feed upstream of the second reactor 170.

Generally, the second reactor 170 may operate under conditions to convert the hydrocarbon feed to smaller hydrocarbon products. $C_{10}$— olefins crack into one or more light olefins, such as ethylene and/or propylene. A second reactor vessel 194 is in downstream communication with the second reactor riser 180 for receiving upgraded products and catalyst from the second reactor riser. The mixture of gaseous, upgraded product hydrocarbons and catalyst continues upwardly through the second reactor riser 180 and is received in the second reactor vessel 194 in which the catalyst and gaseous hydrocarbon, upgraded products are separated. A pair of disengaging arms 196 may tangentially and horizontally discharge the mixture of gas and catalyst from a top of the second reactor riser 180 through one or more outlet ports 198 (only one is shown) into the second reactor vessel 194 that effects partial separation of gases from the catalyst. The catalyst can drop to a dense catalyst bed 200 within the second reactor vessel 194. Afterwards, the upgraded hydrocarbon products can be separated from the catalyst and be removed from the second reactor 170 through an outlet 204 in downstream communication with the second reactor 170 through an upgraded products line 206. The upgraded products in upgraded products line 206 may be directed to one or more cyclones 32 in the first reactor vessel 20 of the first reactor 10. These cyclones 32 may be dedicated just to the upgraded products from the second reactor 170 with a dedicated line (not shown) to the product fractionation section 90 or specifically the gas concentration section 114 or may just mix with the products from the first reactor riser 12 and travel together to the product fractionation section 90 in line 88. Alternatively, the second reactor vessel 194 may contain or have one or more cyclones to further separate gaseous upgraded products from catalyst and travel via upgraded products line 206 to the gas concentration section 114 of the product fractionation section 90. Upgraded products line 206 may alternatively deliver upgraded products to line 88 for transport to the main column 100 of the product fractionation section 90.

In some embodiments, the second reactor 170 can contain a mixture of the first and second catalyst components as described above. In one preferred embodiment, the second reactor 170 can contain less than about 20 wt-%, preferably about 5 wt-% of the first component and at least 20 wt-% of the second component. In another preferred embodiment, the second reactor 170 can contain only the second component, preferably a ZSM-5 zeolite, as the catalyst.

Separated catalyst may be recycled via a recycle catalyst pipe 208 from the second reactor vessel 194 regulated by a control valve 210 back to the second reactor riser 180 to be contacted with the second feed. Optionally, catalyst can be provided from the stripping section 44 of the first FCC reactor via a pipe 214 and/or the regenerator vessel 60 via a pipe 216 both regulated by control valves to the second reactor 170. Both pipes 214 and 216 may be in upstream communication with the recycle catalyst pipe 208. Catalyst return pipe 176 may be a part of the recycle catalyst pipe 208. In an embodiment, catalyst from the second reactor vessel 194 is delivered by pipe 202 to the first reactor, preferably to the stripping section 44, and is delivered, preferably after stripping, via spent catalyst conduit 54 to the regenerator vessel 60 for regeneration. Regenerated catalyst may be returned by pipe 216 back to the base of the second reactor riser 180 via catalyst return pipe 176. In this embodiment, the catalyst in the first and second reactors 10 and 170 are mixed and may be of uniform composition in both reactors.

In another embodiment, the second reactor 170 is isolated from the regenerator vessel 60, so that regenerated catalyst is only returned to the first reactor 10 and the second reactor 170 does not send catalyst to the regenerator vessel 60 or receive regenerated catalyst therefrom. In this embodiment, the second catalyst component, by not being exposed to repeated regenerations, retains more of its activity. Instead, the second catalyst component can be added to the second reactor 170 and the catalyst in the second reactor vessel 194 can be periodically or continuously dispensed through the pipe 202 regulated by a control valve to the stripping section 44 of the first reactor 10. The dispensed catalyst can combine with the catalyst in the first reactor 10 and provide additional catalyst activity therein. Fresh catalyst can replace dispensed catalyst to maintain activity in the second reactor 170.

The second reactor riser 180 can operate in any suitable condition, such as a temperature of about 425° to about 705° C., preferably a temperature of about 550° to about 600° C., and a pressure of about 40 to about 700 kPa, preferably a pressure of about 40 to about 400 kPa, and optimally a pressure of about 200 to about 250 kPa. Typically, the residence time of the second reactor riser 180 can be less than about 5 seconds and preferably is between about 2 and about 3 seconds. Exemplary risers and/or operating conditions are disclosed in, e.g., US 2008/0035527 A1 and U.S. Pat. No. 7,261,807 B2.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A fluid catalytic cracking apparatus, comprising:

a riser for contacting a hydrocarbon feed with catalyst to produce products;

a catalyst pipe in communication with said riser for delivering catalyst to said riser;

a feed line for carrying hydrocarbon feed;

a feed distributor in communication said feed line and with said riser for delivering said hydrocarbon feed to said riser;

a reactor vessel in communication with said riser for receiving products and catalyst from said riser; and a sulfiding agent line, distinct from said feed line, in communication with said riser.

2. The fluid catalytic cracking apparatus of claim 1 further comprising a fluidizing gas distributor in communication with said riser for fluidizing catalyst in said riser.

3. The fluid catalytic cracking apparatus of claim 2 wherein said sulfiding agent line is in upstream communication with said feed distributor or said fluidizing gas distributor.

4. The fluid catalytic cracking apparatus of claim 1 further comprising a main column in upstream communication with said feed distributor for providing hydrocarbon feed to said feed distributor.

5. The fluid catalytic cracking apparatus of claim 4 further comprising a first fluid catalytic cracking reactor in upstream communication with said main column for providing products to said main column.

6. The fluid catalytic cracking apparatus of claim 1 further comprising a main column having an overhead line in communication with said sulfiding agent line for providing dry gas to said sulfiding agent line.

7. The fluid catalytic cracking apparatus of claim 1 further comprising a regenerator vessel in downstream communication with said first fluid catalytic cracking reactor for combusting coke from catalyst received from said first fluid catalytic cracking reactor.

8. A fluid catalytic cracking apparatus, comprising:

a first fluid catalytic cracking reactor comprising a first riser for contacting a hydrocarbon feed with catalyst to produce cracked products and spent catalyst;

a second reactor in downstream communication with said first fluid catalytic cracking reactor for contacting cracked products with catalyst to produce upgraded products;

a feed distributor in communication with said second reactor for delivering cracked products to said second reactor;

an outlet in communication with said second reactor for removing upgraded products from said second reactor; and a sulfiding agent line in communication with said second reactor.

9. The fluid catalytic cracking apparatus of claim 8 further comprising a fluidizing gas distributor in communication with said second reactor for fluidizing catalyst in said second reactor.

10. The fluid catalytic cracking apparatus of claim 9 wherein said sulfiding agent line is in communication with said feed distributor or said fluidizing gas distributor.

11. The fluid catalytic cracking apparatus of claim 8 further comprising a main column in downstream communication with said first riser and in upstream communication with said feed distributor for providing cracked products to said feed distributor.

12. The fluid catalytic cracking apparatus of claim 8 further comprising a main column in downstream communication with said first riser and said main column having an overhead line in upstream communication with said sulfiding agent line for providing dry gas to said second reactor.

13. The fluid catalytic cracking apparatus of claim 8 further comprising a regenerator vessel in downstream communication with said first fluid catalytic cracking reactor for combusting coke from spent catalyst received from said first fluid catalytic cracking reactor.

14. A fluid catalytic cracking apparatus, comprising:

a riser for contacting a hydrocarbon feed with catalyst to produce products;

a catalyst pipe in communication with said riser for delivering catalyst to said riser;

a feed distributor in communication with said riser for delivering hydrocarbon feed to said riser;

a reactor vessel in communication with said riser for receiving products and catalyst from said riser; and a main column having an overhead line in upstream communication with said riser for providing dry gas to said riser.

15. The fluid catalytic cracking apparatus of claim 14 further comprising a fluidizing gas distributor in communication with said riser for fluidizing catalyst in said riser.

16. The fluid catalytic cracking apparatus of claim 15 wherein said overhead line is in upstream communication with said feed distributor or said fluidizing gas distributor.

17. The fluid catalytic cracking apparatus of claim 14 wherein said main column is in upstream communication with said feed distributor for providing hydrocarbon feed to said feed distributor.

18. The fluid catalytic cracking apparatus of claim 14 further comprising a first fluid catalytic cracking reactor in upstream communication with said main column for providing products to said main column.

19. The fluid catalytic cracking apparatus of claim 18 further comprising a regenerator vessel in downstream communication with said first fluid catalytic cracking reactor for combusting coke from catalyst received from said first fluid catalytic cracking reactor.

* * * * *